US005475985A

United States Patent [19]

Heinrichs et al.

[11] Patent Number: 5,475,985

[45] Date of Patent: Dec. 19, 1995

[54] ELECTRONIC CONTROL OF LIQUID COOLED COMPRESSOR MOTORS

[75] Inventors: Anton D. Heinrichs, Canastota; Peter P. Narreau, Pennellville, both of N.Y.

[73] Assignee: Carrier Corporation, Syracuse, N.Y.

[21] Appl. No.: 167,372

[22] Filed: Dec. 14, 1993

[51] Int. Cl.[6] ..... F25B 31/00

[52] U.S. Cl. ..... 62/117; 62/205; 62/505

[58] Field of Search ..... 62/505, 205, 222, 62/117

[56] References Cited

FOREIGN PATENT DOCUMENTS 0034158 3/1979 Japan ..... 62/505

405026525 2/1993 Japan ..... 62/505

2039040 7/1980 United Kingdom ..... 62/505

*Primary Examiner*—William E. Wayner

[57] ABSTRACT

Liquid refrigerant is injected into the motor of a motor-compressor to cool the motor. Refrigerant is also injected to control the discharge temperature of the compressor. The refrigerant for controlling the discharge temperature may be either excess refrigerant for cooling the motor or refrigerant injected into the compressor under the control of a thermal expansion valve.

2 Claims, 2 Drawing Sheets

ELECTRONIC CONTROL OF LIQUID COOLED COMPRESSOR MOTORS

BACKGROUND OF THE INVENTION

Compressors used in refrigeration and air conditioning applications require cooling of the compressor motor. If suction gas is not used to cool the motors and economizer gas does not provide enough cooling, liquid injection can be used for motor cooling. Problems can arise from using liquid injection due its impact on maintaining control over other system parameters. Another problem associated with liquid injection is excess liquid under low load conditions.

SUMMARY OF THE INVENTION

A thermistor supplied in the motor windings is used to send a signal to a microprocessor which controls an electronic expansion valve in the liquid injection line. This optimizes the amount of flow across the motor and minimizes power losses with excess liquid entering the compression process further down stream. This also enhances the reliability of the compressor running gear by minimizing the amount of liquid washing oil from the parts due to the natural affinity between refrigerant and oil. In one embodiment, the compressor discharge temperature is sensed and a signal sent to the microprocessor which controls liquid injection for cooling the motor and to also control the discharge temperature. In a second embodiment, the motor temperature is sensed and liquid injection is controlled for cooling the motor. Also, the compressor discharge temperature is sensed and controls a thermal expansion valve in a liquid injection line discharging into the compressor to control the discharge temperature of the compressor.

It is an object of this invention to provide efficient motor cooling without losing control over other system parameters.

It is a further object of this invention to efficiently cool the motor and discharge temperature of a motor-compressor.

Basically, liquid injection is used to cool the motor of a motor compressor responsive to the motor temperature. Additionally, the discharge temperature of the compressor is controlled either through additional liquid injection in the motor or through injection in the compressor under the control of a thermal expansion valve.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
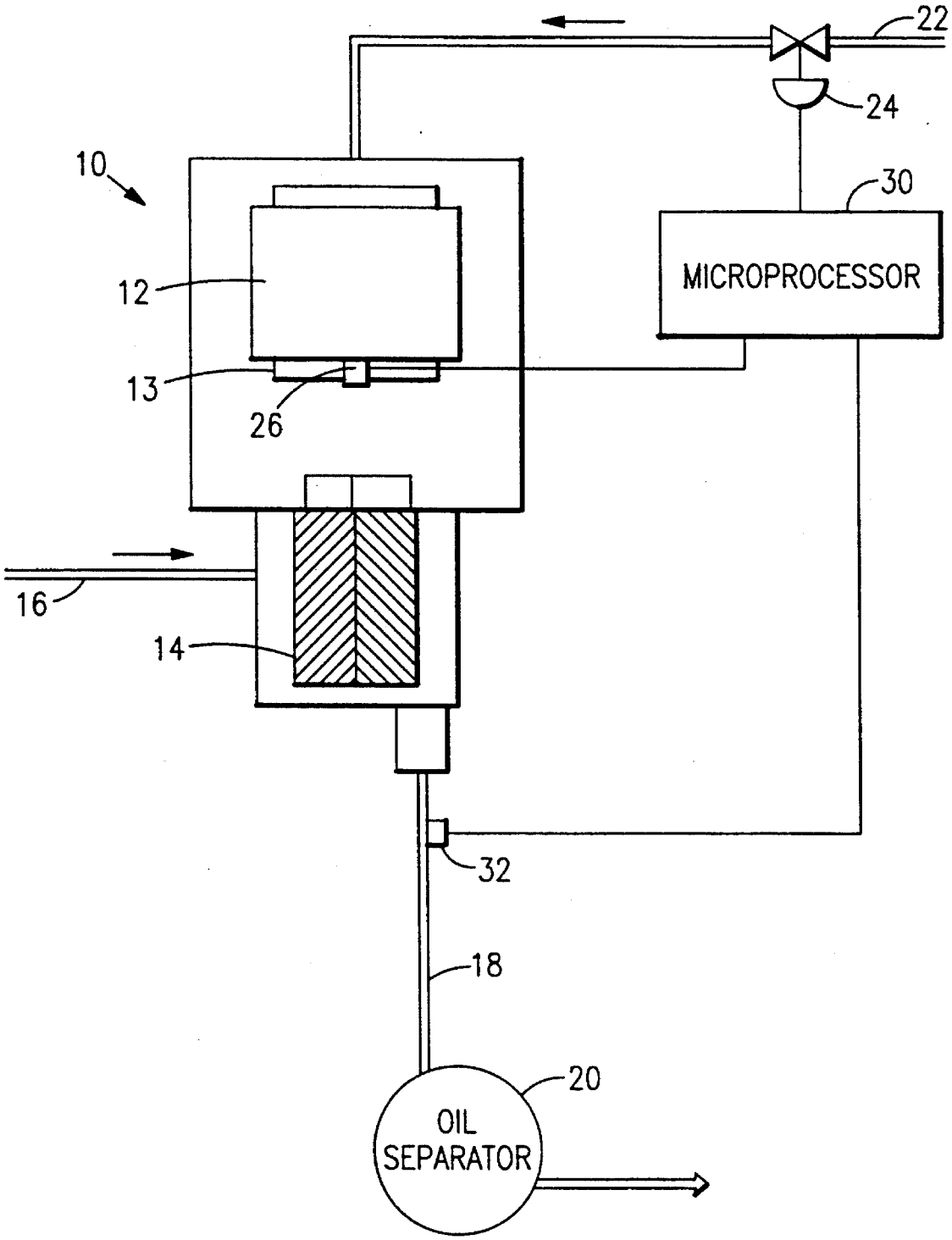
FIG. 1 is a schematic representation of a first motor cooling and discharge temperature control.
Figure 2:
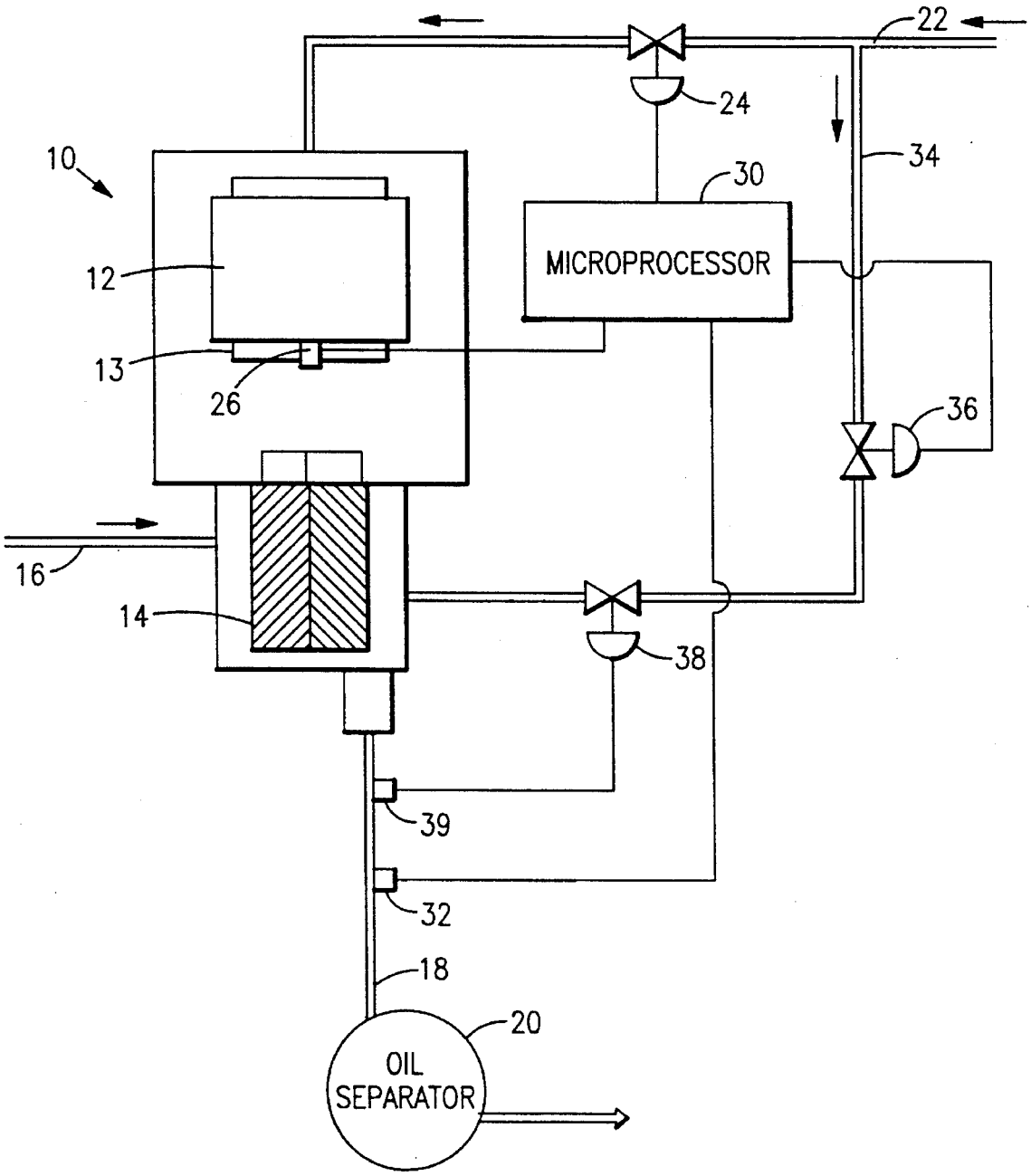
FIG. 2 is a schematic representation of a second motor cooling and discharge temperature control.

In FIGS. 1 and 2 the numeral 10 generally designates a motor-compressor including motor 12 and compressor 14. Compressor 14, which is illustrated as a screw compressor, is driven by motor 12 receives gaseous refrigerant via suction line 16 and discharges hot, high pressure gas via line 18. Line 18 leads to a condenser (not illustrated) and contains an oil separator 20 where oil is removed from the refrigerant for return to the compressor 14 for lubrication.

Liquid injection line 22 is connected to motor-compressor 10 and contains pulsed solenoid valve 24. Thermistor 26 is located on the windings 13 of motor 12. Microprocessor 30 receives a signal from thermistor 26 representative of the temperature of motor 12 and controls valve 24.

In the FIG. 1 embodiment, thermal sensor or thermistor 32 is located on discharge line 18 and sends a signal to microprocessor 30 indicative of the discharge temperature of compressor 14. In the FIG. 2 embodiment branch liquid injection line 34 extends from line 22 to the compressor 14 where the refrigerant is injected for discharge temperature control. Line 34 contains solenoid valve 36 and thermal expansion valve 38 which is controlled responsive to the discharge temperature sensed by thermal sensor 39.

In operation, motor 12 of motor-compressor 10 drives compressor 14 causing gas to be drawn into compressor 14 via suction line 16. The gas is compressed and heated by compressor 14 and discharged via discharge line 18. The temperature of the windings 13 of motor 12 is sensed by thermistor 26 and the temperature of the compressor discharge is sensed by thermistor 32. In the FIG. 1 embodiment, microprocessor 30 receives signals from thermistors 26 and 32 and controls pulsed valve 24 and thereby the flow of liquid refrigerant injected in to motor 12 for motor cooling and, in addition, for controlling the discharge temperature. Because the motor cooling flow mixes with the gas being compressed in compressor 14, excess liquid refrigerant for cooling the motor will function to lower the discharge gas temperature of the compressor. In the FIG. 2 embodiment microprocessor receives a signal from thermistor 26 and controls pulsed valve 24 responsive thereto so as to control liquid refrigerant injected for motor cooling. Valve 36 is opened by microprocessor 30 responsive to the discharge temperature sensed by thermistor 32 and permits the injection of refrigerant into compressor 14 under the control of thermal expansion valve 38 to control the discharge temperature of compressor 14. Thermal expansion valve 38 is controlled responsive to the discharge temperature sensed by thermal sensor 39.

Although a preferred embodiment of the present invention has been illustrated and described, other changes will occur to those skilled in the art. It is therefor intended that the scope of the present invention is to be limited only by the scope of the appended claims.

What is claimed is:

1. A motor-compressor including a compressor for drawing in and compressing refrigerant gas and discharging hot, high pressure discharge refrigerant gas into a discharge line, a motor having windings and driving said compressor, and temperature control means comprising:

means for sensing a parameter representative of operating temperature of said motor;

means for sensing a parameter representative of discharge gas temperature;

means for supplying liquid refrigerant for cooling said motor and said discharge gas wherein said means for supplying liquid refrigerant includes a first line for supplying liquid refrigerant to said motor and second line for supplying liquid refrigerant to said compressor and means for controlling said means for supplying liquid refrigerant responsive to said means for sensing a parameter representative of operating temperature of said motor and to said means for sensing a parameter representative of discharge gas temperature; and said means for controlling includes means for controlling flow in said first line responsive to operating temperature sensed by said means for sensing a parameter representative of operating temperature of said motor and means for controlling flow in said second line responsive to discharge gas temperature sensed by said means for sensing a parameter representative of charge gas temperature.

2. A method for controlling motor temperature and discharge gas temperature of a compressor of a motor-compressor comprising the steps of:

sensing a parameter representative of motor temperature;

sensing a parameter representative of discharge gas temperature;

supplying liquid refrigerant to said motor responsive to sensed motor temperature, for cooling said motor and discharge gas from said compressor; and supplying liquid refrigerant to said compressor responsive to sensed discharge gas temperature.

* * * * *